United States Patent [19]

Rao et al.

[11] Patent Number: 5,072,078

[45] Date of Patent: Dec. 10, 1991

[54] ROTARY SWITCH

[75] Inventors: Chepur P. Rao, North Kingstown; Juan J. Barrena, Providence; John J. Astley, Barrington, all of R.I.

[73] Assignee: Tower Manufacturing Corporation, Providence, R.I.

[21] Appl. No.: 599,663

[22] Filed: Oct. 18, 1990

[51] Int. Cl.[5] ..... H01H 19/58; H01H 21/78

[52] U.S. Cl. ..... 200/11 R; 200/11 C

[58] Field of Search ..... 200/11 R, 11 B, 11 C, 200/11 G

[56] References Cited

U.S. PATENT DOCUMENTS

| | | | |
|---|---|---|---|
| 2,813,158 | 11/1957 | Hutt | 200/6 BB |
| 3,214,536 | 10/1965 | Wallace | 200/11 C |
| 4,045,637 | 8/1977 | Mongeau | 200/6 BB |

*Primary Examiner*—Harold Broome

*Attorney, Agent, or Firm*—Salter & Michaelson

[57] ABSTRACT

A rotary switch for small appliances such as electric fans comprising base and cover assemblies, the former having low, medium and high output terminals and a splice terminal in side-by-side relation along one edge thereof for wedgingly receiving the bared ends of a ribbon cable, or alternatively receiving the bared ends of separate leads, and with the input terminal and the opposite end of the splice terminal being located at the opposite edge of the base. The cover assembly carries a rotor having contacts connected thereto whereby the rotor may be rotated so as to effect an electrical connction between either the low, medium or high output terminal and the input terminal. The cover further has a plurality of partitions which serve to isolate from each other the bared ends of the leads that engage the output terminals, when the cover and base are assembled to each other.

6 Claims, 2 Drawing Sheets

ROTARY SWITCH

BACKGROUND OF THE INVENTION

The present invention relates generally to electric switches for small appliances, and is more particularly concerned with the provision of a rotary switch primarily for use with electric fans to control "off-on", as well as fan motor speeds, namely, low, medium, and high. Switches of this general type are old and well known in the art, reference being made, for example, to the switches disclosed in Hutt U.S. Pat. No. 2,813,158 issued Nov. 12, 1957, and Mongeau U.S. Pat. No. 4,045,637 issued Aug. 30, 1977. However, there has long been a need for switches of this type that are less labor intensive insofar as manufacture and assembly are concerned, and which achieve maximum compactness.

One of the primary manufacturing problems that exists in switches similar to those disclosed in the aforesaid Hutt and Mongeau patents results from the fact that the leads from the motor are connected to switch terminals located at the four corners of the switch. This requires the worker who is connecting these leads to the switch to rotate the switch three times after inserting the first wire in order to insert the remaining three wires, it being understood that three of the wires coming from the motor are output leads defining low, medium and high motor speeds, while the fourth is the input lead of the power cord. In any event, the fact that the leads have heretofore been connected to the four corners of the switch very definitely increases the time of assembly. In addition, where the leads are connected to switch terminals located remotely from each other, it has heretofore been necessary to comb down and bunch and tie the four separate wires in order to make sure that they do not come in engagement with the fan blade.

Obviously where the terminals are located at the corners of the switch, it is not possible to use ribbon cable for electrically interconnecting the motor and the switch. For obvious reasons, use of ribbon cable would minimize assembly time.

SUMMARY OF THE INVENTION

The primary object of the present invention is to provide a rotary switch that is more compact than heretofore existing switches, thus enabling the switch to be mounted in a smaller space and in more compact fans.

Another object of the present invention is to provide a rotary switch that has the capability of utilizing ribbon cable for electrically interconnecting the switch and the appliance motor, but at the same time having the capability of receiving separate leads where such is desired.

In accomplishing the above objectives, the switch of the present invention utilizes "push-in" type terminals of the general type utilized in the aforesaid Hutt and Mongeau patents, except that in the present invention, instead of the terminals being located at the four corners of the switch, the output terminals and the splice terminal are located in side-by-side relation along one edge of the switch, with the opposite end of the splice terminal and the input terminal being located at the opposite edge of the switch. Having the output terminals and the splice terminal in side-by-side relation along one edge of the switch obviously eliminates the necessity of repeatedly turning the switch during assembly of the motor wires to the switch, and at the same time enables the motor wires to be in the form of a ribbon cable rather than being entirely separate leads, as will hereinafter be described in more detail.

The switch of the instant invention is further advantageous in that it basically consists of two subassemblies, namely, the base assembly and the cover assembly. The cover assembly comprises a cover plate, an actuating shaft carrying an indexing cam and contact members, and a single detent spring which resiliently engages the indexing cam to maintain the actuating shaft assembled to the cover plate, thus resulting in all of the parts of the cover assembly being held together during handling and assembly thereof to the base assembly. By the same token, the output, input and splice terminals of the base assembly are firmly secured in place so that the base assembly can also be handled without the parts thereof falling out. The fact that both the cover and base assemblies do not have any loose parts that are prone to falling out during handling obviously minimizes assembly time.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE PREFERRED FORM OF THE INVENTION

Figure 1:
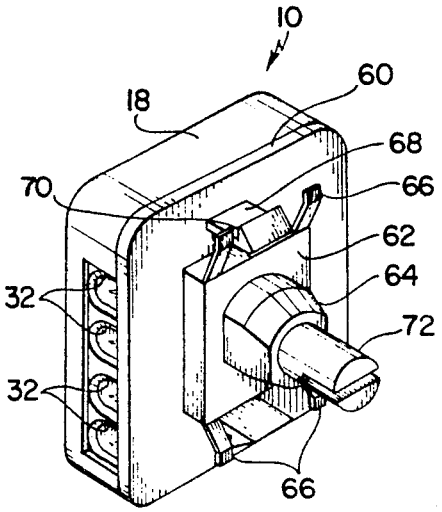
FIG. 1 a perspective view of the rotary switch of the present in assembled relation.

Referring now to the drawings, the switch of the present invention, shown generally at 10, comprises a base assembly shown generally at 12 and a cover assembly shown generally at 14. Except for the electrical components and the detent spring, the base and cover assemblies are both constructed of molded plastic so as to be electrically non-conductive. In order to arrive at the completed switch 10, the cover assembly 14 is secured to the base assembly 12 by any suitable means, such as ultrasonic welding. As will be noted, the switch 10 is of rectangular configuration, preferably of generally square configuration.

The base assembly 12 comprises a base or housing consisting of bottom wall 16 having a peripheral flange or wall 18 extending upwardly therefrom. Secured to bottom wall 16 in side-by-side relation are output terminals 20, 22, and 24, and splice terminal 26 which extends across the switch to the opposite edge thereof, as will be seen most clearly in FIGS. 2 and 3. Input terminal 28 is also located on the opposite side of the switch, preferably at the center portion thereof. Each of the aforesaid terminals comprise flat contact portions that are secured to bottom wall 16 and upwardly-bent end portions 30 located adjacent apertures 32 which are provided in peripheral flange 18. The terminals 20, 22, 24, 26 and 28 are all constructed of a resilient, electrically conductive material, such as beryllium copper, whereby the upstanding end portions 30 will flex inwardly when an electrical wire is pressed thereagainst. As a result of such inward flexing, the wire, from which insulation has been stripped, will enter into the switch housing in wedging engagement with the edge of portion 30 so as to effect good electrical contact therewith. This type of connection, which is old and well known in the art and forms no part of the present invention, is commonly referred to as a "push-in" connection.

Figure 3:
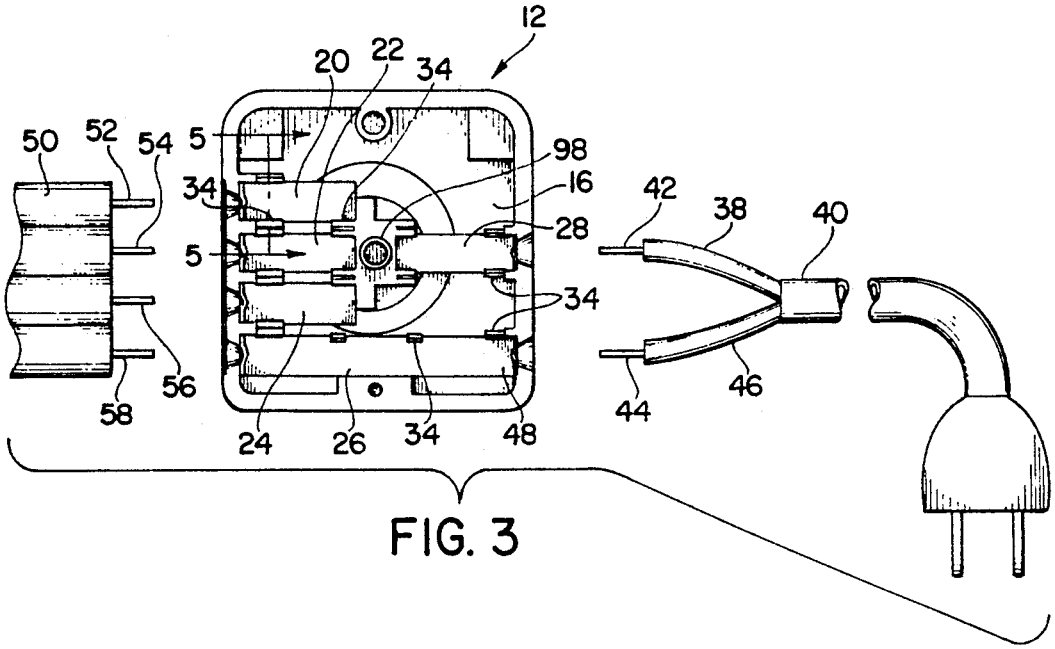
FIG. 3 a plan view of the base assembly also showing the ribbon cable from the motor and the power cord.
Figure 4:
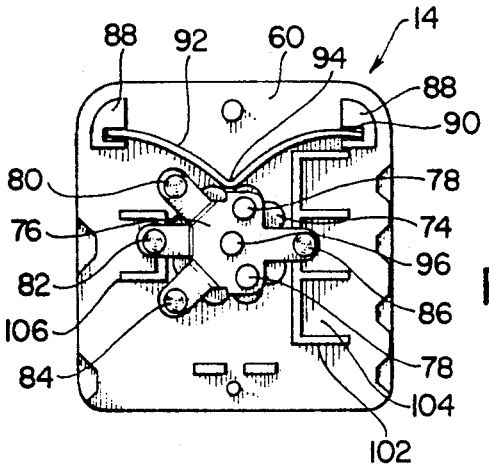
FIG. 4 is a plan view of the inner surface of the cover assembly.
Figure 5:
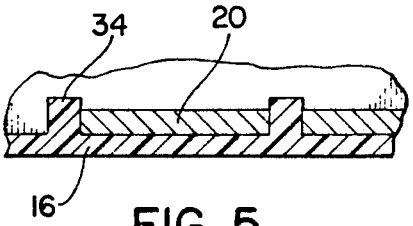
FIG. 5 is a section taken on lines 5—5 of FIG. 3 before the upper edges of the partitions have been offset to secure the terminals in place.
Figure 6:
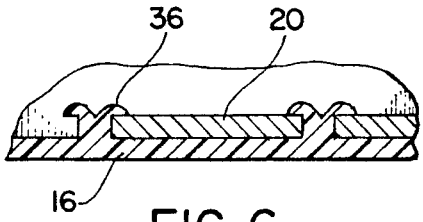
FIG. 6 is a view similar to FIG. 5 after the upper edges of the partitions have been offset.

Since it is obviously critical that the terminals 20, 22, 24 and 26 be spaced from each other, integral abutments 34 extend upwardly from bottom all 16 and are located between the flat contact portions of adjacent terminals, as illustrated in FIGS. 3 and 5. The upper edges of the abutments 34 are then offset, as shown in FIG. 6 at 36. This secures the terminals firmly in place against bottom wall 16 and at the same time insures the proper spacing between adjacent terminals. The same abutments are also located adjacent opposite side edges of input terminal 28 and splice terminal 26 in order to maintain the entire length of splice terminal 26 firmly in place and in order to also maintain input terminal 28 firmly in place. As will be noted in FIG. 3, input lead 38 of power cord 40, after the end 42 thereof has been bared in insulation, is adapted to be forced into the aperture adjacent input terminal 28 so as to make electrical connection therewith. At the same time, the bared end 44 of neutral lead 46 is adapted to be pressed into the aperture adjacent end 48 of splice terminal 26 so as to make electrical connection therewith. By the same token, ribbon cable 50 coming from the appliance motor (not shown) has bared ends 52, 54, 56 and 58 adapted to be forced into the apertures adjacent terminals 20, 22, 24 and 26, respectively. Lead 58 is, of course, a common lead that is electrically interconnected to neutral lead 46 by means of splice terminal 26, it being understood that rotary switching means, hereinafter to be described, will selectively interconnect power lead 42 and input terminal 28 to one of the terminals 20, 22, and 24 to achieve low, medium or high motor speed for the appliance to which cable 50 is connected. Although the capability of receiving a ribbon cable, as just described, is an important feature of the present invention, it will be understood that it is certainly not essential that a ribbon cable be used, since individual and separate leads could be substituted therefor for electrical engagement with the output and splice terminals.

Figure 2:
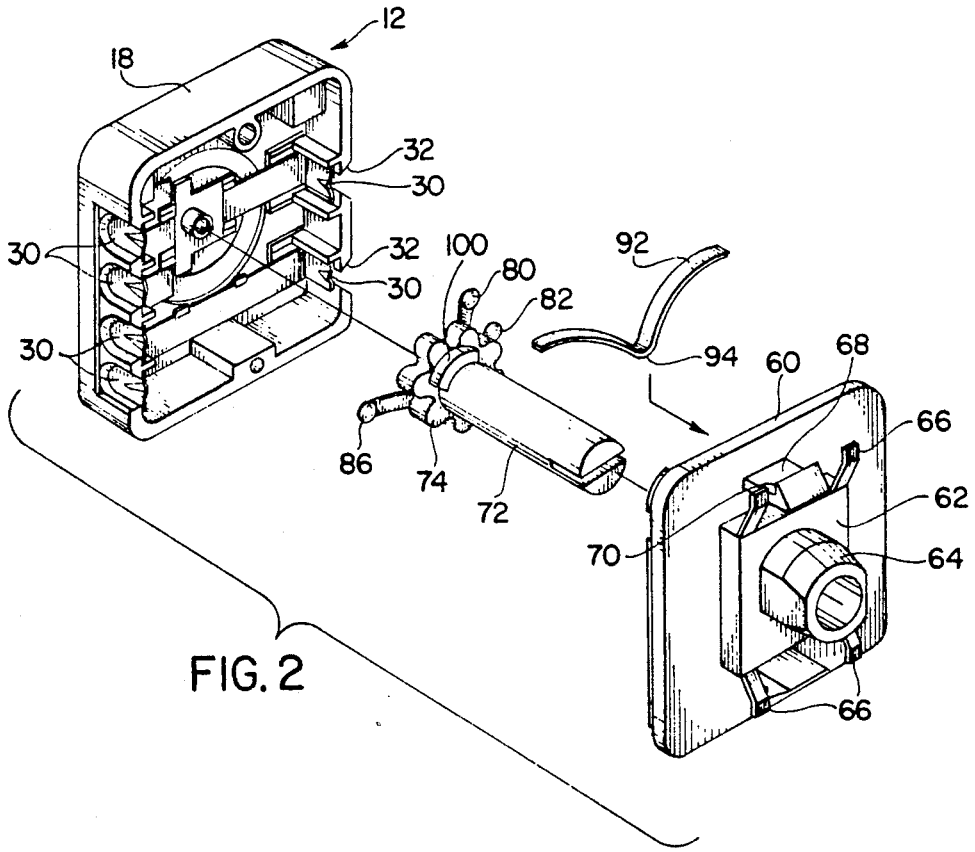
FIG. 2 is an exploded perspective view thereof.

The cover assembly 14 comprises a cover plate 60 having on its outer surface, as seen most clearly in FIGS. 1 and 2, an integral square projection 62 having a hub 64 extending therefrom and further having clip fingers 66 and latch member 68 having a latching shoulder 70 extending from projection 62 so that the switch may be wall mounted when desired. Specifically, the mounting wall (not shown) would have an opening configured to snugly receive projection 62 and latch member 68 therethrough whereby the supporting wall would actually be clamped between latching shoulder 70 and clip fingers 66. An actuating shaft 72 is provided with an integral indexing cam 74 having an undulating outer edge, with a movable contact member 76 secured to said indexing cam by any suitable means, such as by means of pins 78 extending integrally from indexing cam 74 through openings in the contact 76, the ends of said pins then being offset to hold the contact member securely in place. Contact 76 comprises three contact fingers 80, 82 and 84, and a fourth oppositely disposed contact finger 86. Integrally molded abutments 88 are provided on the inner surface of plate 60 having slots 90 therein for receiving the ends of a generally V-shaped spring 92, the apex 94 of which makes resilient engagement with the undulating periphery of indexing cam 74. A centrally positioned pin 96 extends integrally from cam 74 through an aligned aperture in contact 76 so that when cover assembly 14 is secured to base assembly 12, the end of pin 96 is received in hub 98 integrally carried by bottom wall 16 so as to create an end bearing for the actuating shaft which, of course, at its free end is provided with any suitable knob or handle (not shown). When the cover and base assemblies are secured to each other, contact finger 86 will engage on of the terminals 20, 22 or 24, depending upon the rotary position of shaft 72, so as to effect low, medium or high speed for the appliance fan. At the same time, one of the contact fingers 80, 82 and 84 will be in contact with input terminal 28 to complete the circuit through the switch. Shaft 72 is actually rotatable to a fourth position wherein the contact fingers are out of engagement with the terminals, this being the "off" position of the switch. In order to limit rotary movement of shaft 72, an integral abutment 100 is provided on said shaft adjacent indexing cam 74, said abutment cooperating with an arcuate groove or recess (not shown) provided in the face of plate 60, similar to arcuate recess 92 shown in FIG. 3 of the aforesaid Mongeau patent.

Since the bared lead ends 52, 54, 56 and 58 are in side-by-side relation and relatively close to each other, it is important that these ends be maintained segregated within the switch. In order to accomplish this, the inner surface of cover plate 60 is provided with partition walls 102 which define enclosed spaces 104 that receive bared lead ends 52, 54 and 56 to insure electrical isolation of same. A similar partition wall 106 is adapted to surround bared lead end 42 to insure no short-circuiting between said end and bared end 44, even though the lead ends 42 and 44 are spaced from each other by a substantially greater distance than the spacing between the leads 52, 54, 56 and 58. Thus, when cover plate 60 is secured to the upper edge of peripheral wall 18, the aforesaid partition walls will function to segregate and isolate the bared lead ends, as just described, this being an important feature of our invention.

Although actuating shaft 72 is not actually secured to cover plate 60 in any way prior to assembly of base assembly 12 and cover assembly 14, detent spring 94, being in resilient engagement with indexing cam 74, functions to maintain the actuating shaft assembled to the cover plate so that when the assembly worker finds it necessary to pick up cover assembly 14, such as when it is desired to secure it to base assembly 12, there are no loose parts that will drop from the assembly, thus facilitating and expediting the assembly procedure. By the same token, there are no loose parts in base assembly 12, thus further maximizing assembly efficiency.

The fact that splice terminal 26 is of the "push-in" type, so as not to require use of a wire nut, and the fact that it is mounted within the switch so as to eliminate the necessity of using external splicing means, further contributes to reduction in assembly time and expense.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A rotary switch comprising generally rectangular base and cover assemblies, said base assembly comprising a bottom wall having marginal edges with a peripheral flange extending upwardly therefrom, a splice terminal and a plurality of output terminals mounted on said bottom wall in side-by-side relation adjacent one of the marginal edges of said base, said splice terminal extending across said wall to the opposite marginal edge thereof, an input terminal mounted on said bottom wall adjacent said opposite marginal edge of said base, said cover assembly comprising a cover plate, an actuating shaft carrying a plurality of contact elements rotatably mounted on said plate, means securing the cover plate to the upper edge of said peripheral flange whereby rotation of said shaft effects an electrical connection between a selected one of said output terminals and said input terminal, all of said terminals comprising flat contact portions secured to said bottom wall, and upwardly bent end portions adjacent said base edges, said peripheral wall having apertures therein located adjacent said end portions, thereby defining push-in type terminals, said side-by-side terminals being adapted to receive the ends of a ribbon cable from which insulation has been stripped, or alternatively, the ends of separate leads from which insulation has been stripped.

2. In the switch of claim 1, said base bottom wall and said cover plate being constructed of plastic, said base bottom wall having integral abutments extending upwardly therefrom and located between the flat contact portions of said side-by-side terminals to maintain same in spaced relation, said abutments being offset at the upper portions thereof to maintain said flat contact portions secured to said bottom wall.

3. In the switch of claim 2, said cover plate having a plurality of integral partitions extending therefrom which substantially surround said output terminals in order to isolate each of said ends from each other.

4. In the switch of claim 3, said actuating shaft having integral cam means thereon for releasably maintaining said shaft in any desired rotary position, said cam means comprising a disc having an undulating periphery, and a generally V-shaped spring mounted on said cover plate with its apex in resilient engagement with said disc.

5. A rotary switch comprising base and cover assemblies, the former comprising a bottom wall having mounted thereon a plurality of side-by-side output terminals located adjacent a first edge portion of said bottom wall, a splice terminal mounted on said bottom wall having a first end located adjacent said first edge portion in side-by-side relation to said output terminals, and extending across said wall to the opposite edge thereof, an input terminal mounted on said bottom wall adjacent said opposite wall edge, said cover assembly comprising a cover plate, an actuating shaft carrying a plurality of contacts rotatably mounted on said plate, whereby when the cover plate is assembled to the base, rotation of said shaft effects an electrical connection between a selected one of said output terminals and said input terminal, said actuating shaft having cam means connected thereto for releasably maintaining said shaft in any desired rotary position, said cam means comprising a disc having an undulating periphery, and a generally V-shaped spring mounted on said cover plate with its apex in resilient engagement with said disc.

6. In the switch of claim 5, said cover plate having a plurality of partitions which surround said output terminals when the cover plate is assembled to the base in order to isolate each of said terminals from each other.

* * * * *